US006065983A

United States Patent [19]

Norizuki et al.

[11] Patent Number: 6,065,983

[45] Date of Patent: May 23, 2000

[54] CONNECTOR

[75] Inventors: Teruhisa Norizuki; Shinji Kodama, both of Shizuoka, Japan

[73] Assignee: Yazaki Corporation, Tokyo, Japan

[21] Appl. No.: 09/264,030

[22] Filed: Mar. 8, 1999

[30] Foreign Application Priority Data

Mar. 10, 1998 [JP] Japan ..... 10-058532

[51] Int. Cl.[7] ..... H01R 13/62

[52] U.S. Cl. ..... 439/157; 439/557

[58] Field of Search ..... 439/557, 565, 439/157, 310

[56] References Cited

U.S. PATENT DOCUMENTS 5,238,426 8/1993 Arnett ..... 439/557
5,277,623 1/1994 Colleran et al. ..... 439/557
5,855,486 1/1999 Fukamachi et al. ..... 439/157

FOREIGN PATENT DOCUMENTS 5-61908 8/1993 Japan .

*Primary Examiner*—Gary F. Paumen
*Attorney, Agent, or Firm*—Sughrue, Mion, Zinn, Macpeak & Seas, PLLC

[57] ABSTRACT

A connector, which is attached into an attaching hole formed on a panel body and has an engagement waiting state and a complete engagement state, comprises a first connector housing, a cover member for accommodating the first connector housing so as to be slidable in an engagement direction, a holder for accommodating the cover so as to be engaged therewith provisionally under the engagement waiting state and so as to be slidable in the engagement direction under the complete engagement state, the holder includes at least one pair of stoppers stacking on rear face of the panel body in a peripheral portion of the attaching hole, at least one pair of flexible engagement members elastically abutting against a front face of the panel body in the peripheral portion of the attaching hole and at least one pair of alignment members elastically fitted into the attaching hole; and a second connector housing to be engaged with the first connector housing.

8 Claims, 16 Drawing Sheets

CONNECTOR

BACKGROUND OF THE INVENTION

The present invention relates to a connector suitably used when a male and a female multi-terminal connector housing are smoothly engaged with or disengaged from each other.

Concerning the above type connector, for example, there is disclosed a related connector, which is shown in FIGS. 19 and 20, in Japanese Utility Model Publication No. 5-061908A. This connector 1 includes: a male connector housing 4 attached to an attaching hole 2*a* on a vehicle body panel 2 through a movable holder 3; and a female connector housing 5 engaged with this male connector housing 4.

As shown in FIG. 20, the movable holder 3 is composed as follows. There is provided a rectangular frame 3*a*, at the upper and the lower section on both sides of which press pieces 3*b* secured to the vehicle body panel and U-shaped lance pieces 3*c* are integrally formed being protruded. At the centers between the lance pieces 3*c*, there are provided elastic pieces 3*d* for securing the connector housing 4, wherein these lance pieces 3*c* are integrally protruded from the frame 3*a*.

As shown in FIG. 19, after the movable holder 3 has been secured into the attaching hole 2*a* on the vehicle body panel 2 with the press pieces 3*b* and the lance pieces 3*c* of the frame 3*a*, a flange 4*a* and protrusions 4*b* of the male connector housing 4 are engaged with the elastic pieces 3*d* of the frame 3*a*. Due to the foregoing, the male connector housing 4 is held by the movable older 3. Under the above condition, the male connector housing 4 and the female connector housing 5 are engaged with each other.

However, the following problems may be encountered in the above related connector 1. Since the press pieces 3*b* and the lance pieces 3*c* used for securing the vehicle body panel are formed separately from the elastic pieces 3*d* used for securing the male connector housing. Accordingly, when the connector 1 is secured to the vehicle body panel 2, it is impossible to obtain a sufficiently strong holding force, and further the size of a portion of the vehicle body panel 2 to which the connector is attached is increased.

SUMMARY OF THE INVENTION

The present invention has been accomplished to solve the above problems. It is therefore an object of the present invention to provide a connector characterized in that: a holding force of the connector with respect to a body to which the connector is secured can be increased; and it is possible to reduce a space in which the connector is attached to the body to which the connector is secured.

In order to achieve the above object, there is provided a connector, which is attached into an attaching hole formed on a panel body and has an engagement waiting state and a complete engagement state, comprising: a first connector housing; a cover member for accommodating the first connector housing so as to be slidable in an engagement direction; a holder for accommodating the cover so as to be engaged therewith provisionally under the engagement waiting state and so as to be slidable in the engagement direction under the complete engagement state, the holder includes at least one pair of stoppers stacking on rear face of the panel body in a peripheral portion of the attaching hole, at least one pair of flexible engagement members elastically abutting against a front face of the panel body in the peripheral portion of the attaching hole and at least one pair of alignment members elastically fitted into the attaching hole; and a second connector housing to be engaged with the first connector housing.

Accordingly, the holding force of the connector with respect to the panel body can be increased, and it is possible to reduce a required space in which the connector is attached to the panel body.

The alignment members is formed by erecting an inner portion of a substantially C-shaped slit provided on the each flexible engagement member formed into a shape of a plate, and abutting against an inner edge of the attaching hole.

Accordingly, the alignment member can be easily moved within the slit. Therefore, the connector can be smoothly aligned, that is, the connector can be smoothly positioned at the center of the attaching hole of the panel body.

In the connector, the engagement waiting state includes a first engagement waiting state and a second engagement waiting state, a first engaging arm provided on the cover member is provisionally engaged with a protrusion provided on the first connector housing under the first engagement waiting state and the complete engagement state, and a second engaging arm provided on the cover member is provisionally engaged with a third engaging arm provided on the holder under the first and second engagement waiting states.

The second connector housing includes a hood portion provided in a front portion thereof which is to be inserted into a gap between an outer peripheral face of the cover member and an inner peripheral face of the holder, a first protrusion formed on a front end portion of an inner face of the hood portion, and a trapezoidal second protrusion having a front slant face and a rear slant face, the second protrusion formed on an outer face of the hood portion and located rear side of the first protrusion, the first protrusion flexes the first engagement arm inwards to release the provisional engagement of the first connector housing and the cover member, and the front slant face of the second protrusion flexes both of the second engaging arm and the third engaging arm outwards such that end portions thereof are stuck on each other to keep the provisional engagement of the cover member and the holder under the second engagement waiting state, and the rear slant face of the second protrusion flexes only the third engaging arm outwards to release the provisional engagement of the cover member and the holder under the complete engagement state.

Accordingly, the holding force of the connector with respect to the panel body can be further enhanced.

In the connector, front end portions of the cover member and the holder are tapered.

The cover member and the holder are arranged such that the tapered faces thereof form one substantially continuous slant face under the engagement waiting state.

A slant angle X of the tapered face of the holder and a slant angle Y of the tapered face of the cover member satisfy an inequality: $X \geqq Y$ (here, $X=Y$).

Accordingly, when the hood portion is inserted between the outer peripheral face of the cover member and the inner peripheral face of the holder, the hood portion can be smoothly guided onto the first connector housing side by the tapered face of the holder and the tapered face of the cover member arranged so as to form a substantially continuous slant face. Therefore, there is no possibility that the front end portion of the hood portion collides with the holder and the front end of the cover member and that the provisional engagement of the protrusion of the cover member and the holder is released.

The connector further comprises a lever member disposed in a groove formed on a front end portion of the first connector housing extending in a vertical direction and supported by a pivot formed on the cover member so as to be rotatable in the engaging direction within the groove, and wherein the lever member supports the engagement and disengagement operation of the first connector housing and the second connector housing by a leverage in which the pivot is a point of force, a contact point of a front end portion of the second connector housing and the lever member is a fulcrum and a contact point of the front end portion of the first connector housing and the lever member is a point of application.

According to the leverage, the first and second connector housings are engaged or disengaged even by a low operation force.

DETAILED DESCRIPTION OF THE PREFERRED EMBODIMENTS

Referring to the accompanying drawings, an embodiment of the present invention will be explained below.

Figure 1:
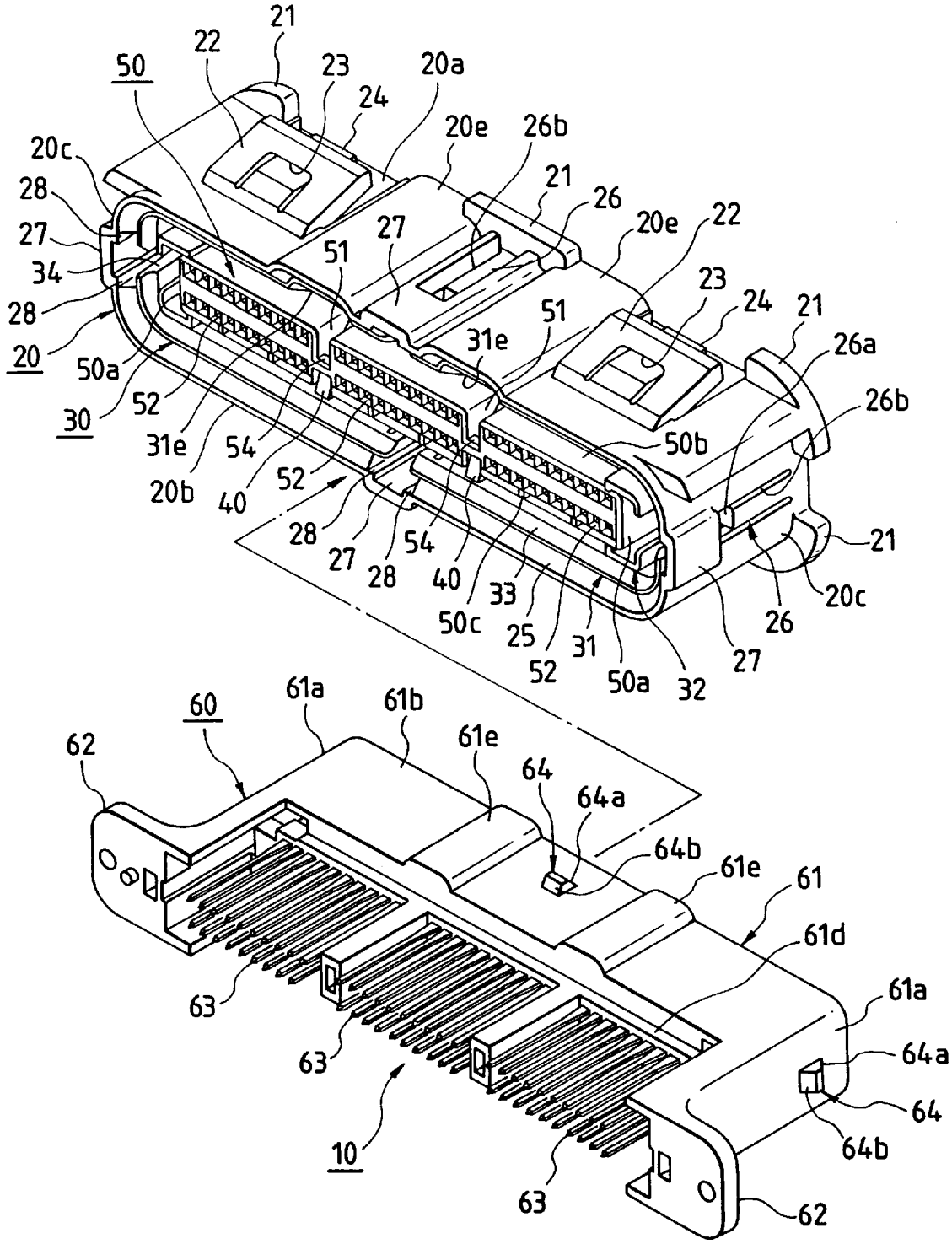
FIG. 1 is a perspective view of a male and a female connector housing, which compose a connector of an embodiment of the present invention, in a state before they are engaged with each other.
Figure 2:
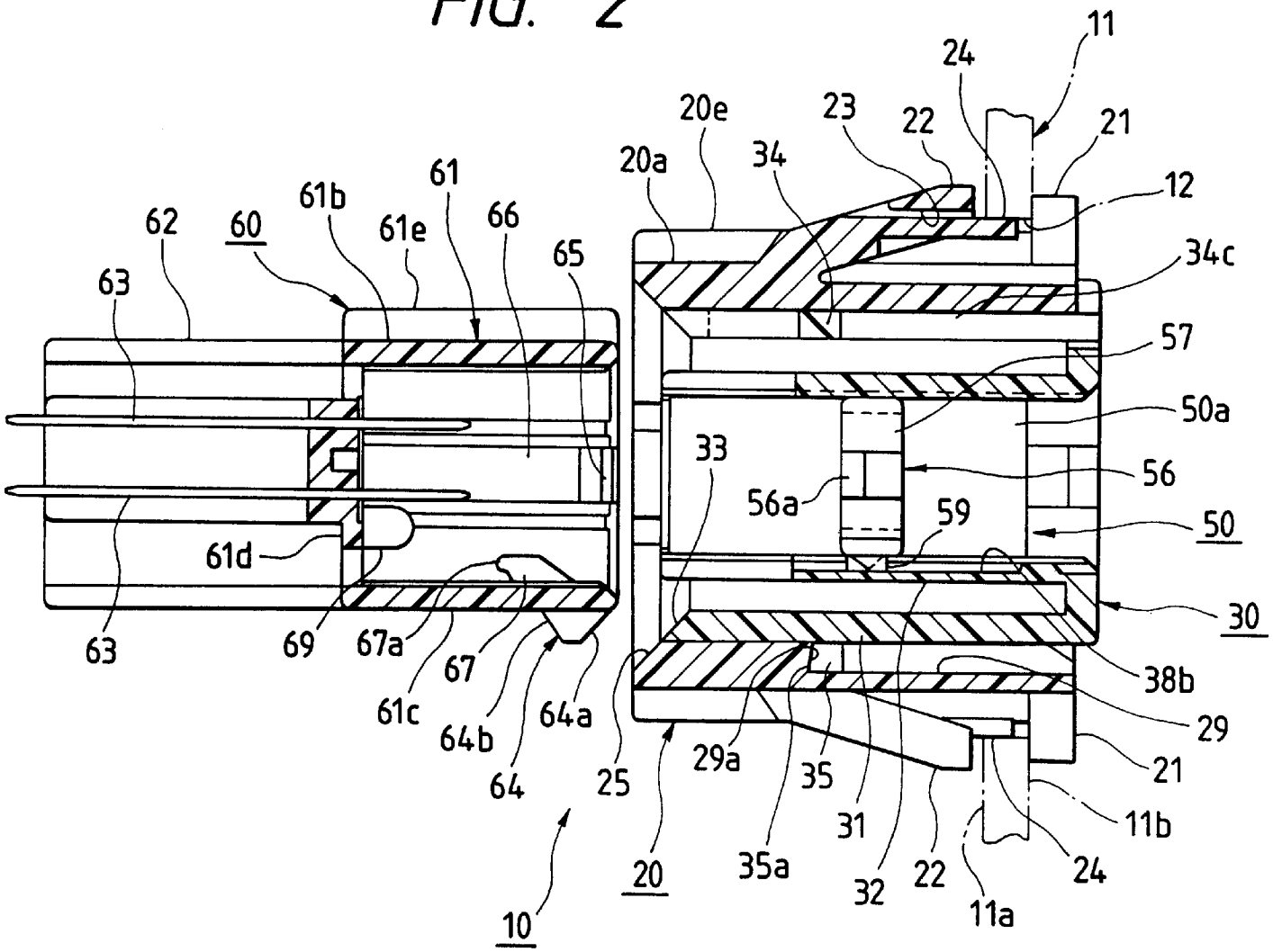
FIG. 2 is a cross-sectional side view of the male and the female connector housing in a state before they are engaged with each other.
Figure 3:
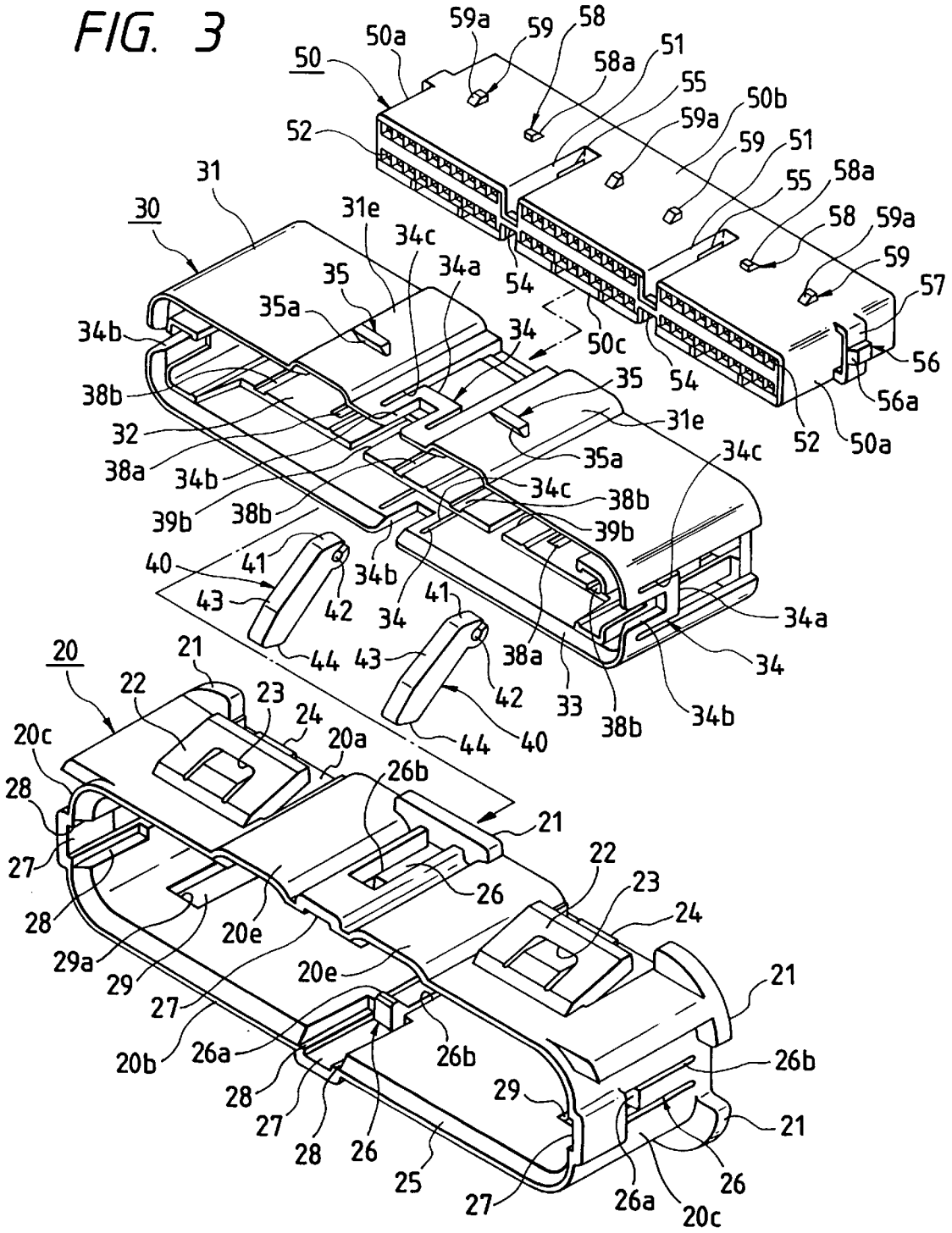
FIG. 3 is an exploded perspective view of the male connector housing.
Figure 4:
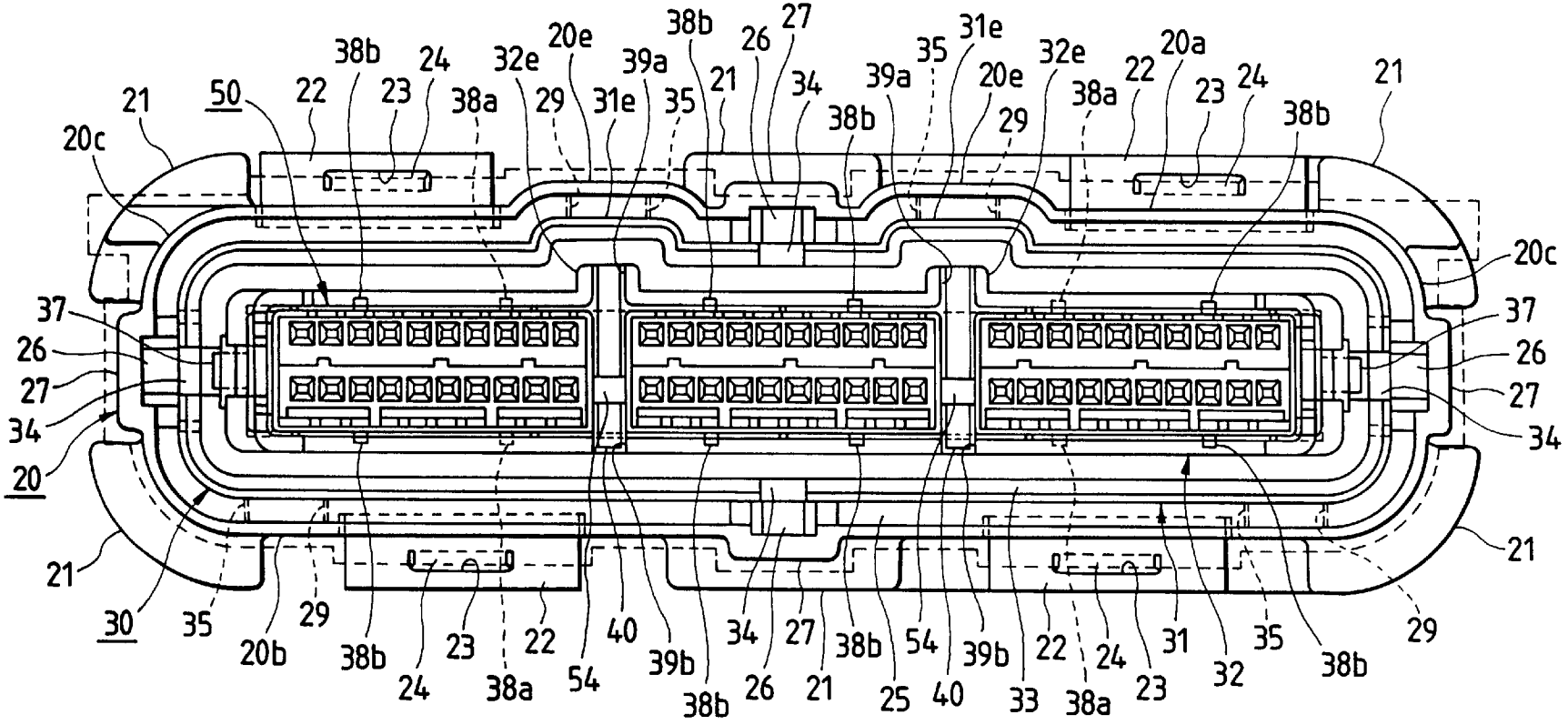
FIG. 4 is a front view of the male connector housing.

FIG. 1 is a perspective view of a male and a female connector housing, which compose a connector of an embodiment of the present invention, and these connector housings are set in a state before they are engaged with each other. FIG. 2 is a cross-sectional side view of the male and the female connector housing shown in FIG. 1. FIG. 3 is an exploded perspective view of the male connector housing. FIG. 4 a front view of the male connector housing. In this connection, engagement sides of the male and the female connector housing are respectively defined as a front side in this specification.

As shown in FIGS. 1 to 3, the connector 10 includes: a substantially square cylinder-shaped holder 20 made of synthetic resin attached to an attaching hole 12 formed on an inner panel (body to which the holder is attached) of a vehicle; a substantially square cylinder-shaped cover 30 made of synthetic resin slidably arranged in the longitudinal direction of the holder 20; a pair of levers 40 made of synthetic resin, the base end sections of which are pivotally supported by the cover 30 so that the male 50 and the female connector housing 60, which will be described later, are engaged with and disengaged from each other by the lever action; a male connector housing (one of the connector housings) 50 made of synthetic resin provisionally engaged in an engagement waiting condition (what is called a waiting condition) and slidably arranged; and a female connector housing (the other connector housing) 60 made of synthetic resin engaged with and disengaged from the male connector housing 50 which is in an engagement waiting condition.

As shown in FIGS. 1 to 3, the holder 20 is composed of an upper wall 20*a*, a lower wall 20*b* and both side walls 20*c*, 20*c* into a substantially square cylinder-shape. In this holder 20, the cover 30 is slidably supported. At four corners at the rear end of the rear opening formed by the walls 20*a*, 20*b* and 20*c* of this holder, and at centers of the rear ends of the upper wall 20*a* and the lower wall 20*b*, stoppers 21 vertically extending outside are respectively formed in such a manner that they are protruding integrally. On both sides of the upper 20*a* and the lower wall 20*b* of the holder 20, there are respectively provided flexible engagement members 22 which are tapered upward from the front side to the rear side. In each flexible engagement member 22, there is integrally formed an alignment member 24 so as to horizontally extend backwards through a C-shaped slit 23.

Figure 10:
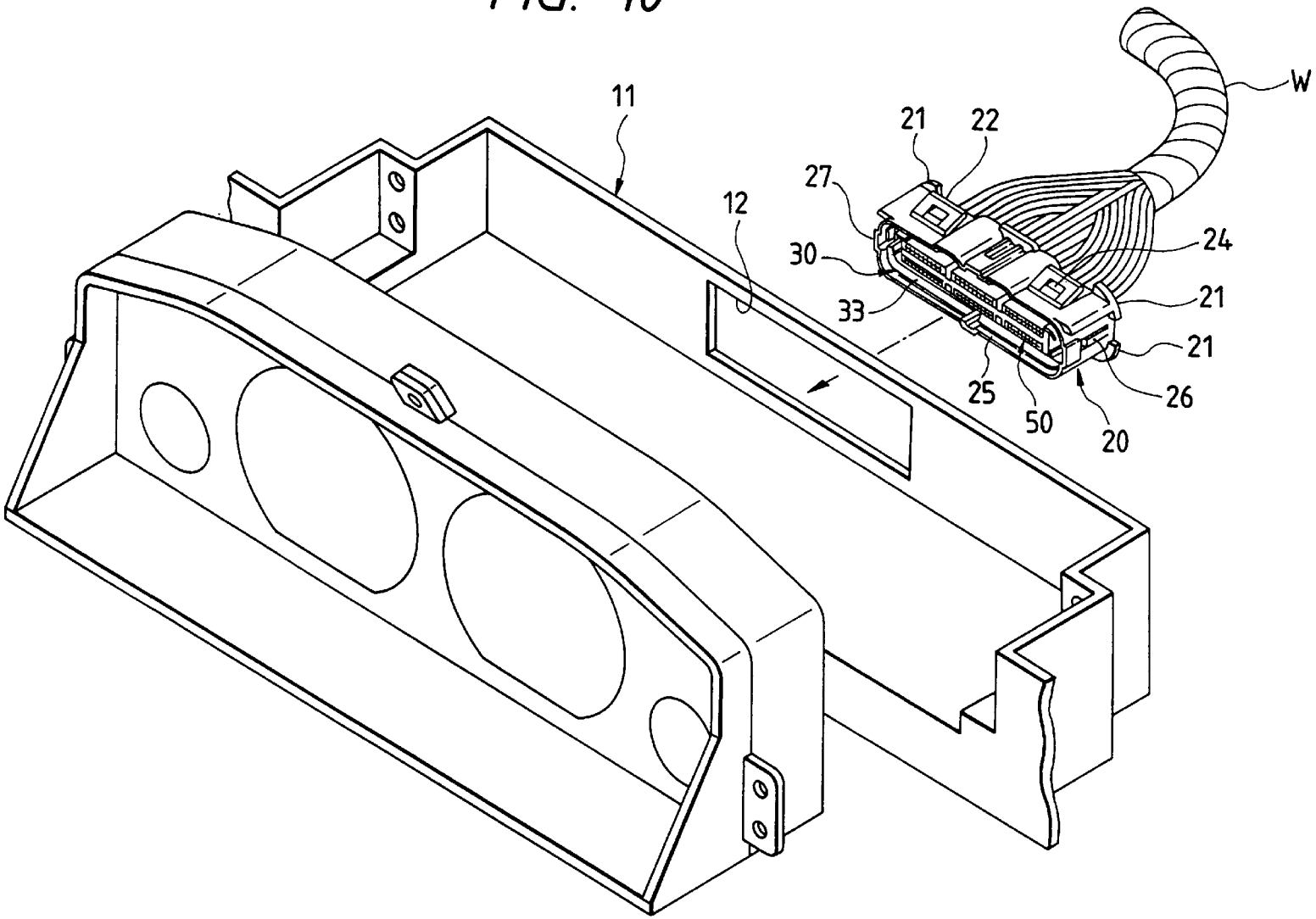
FIG. 10 is a perspective view showing a state before the connector is attached to an inner panel.
Figure 11:
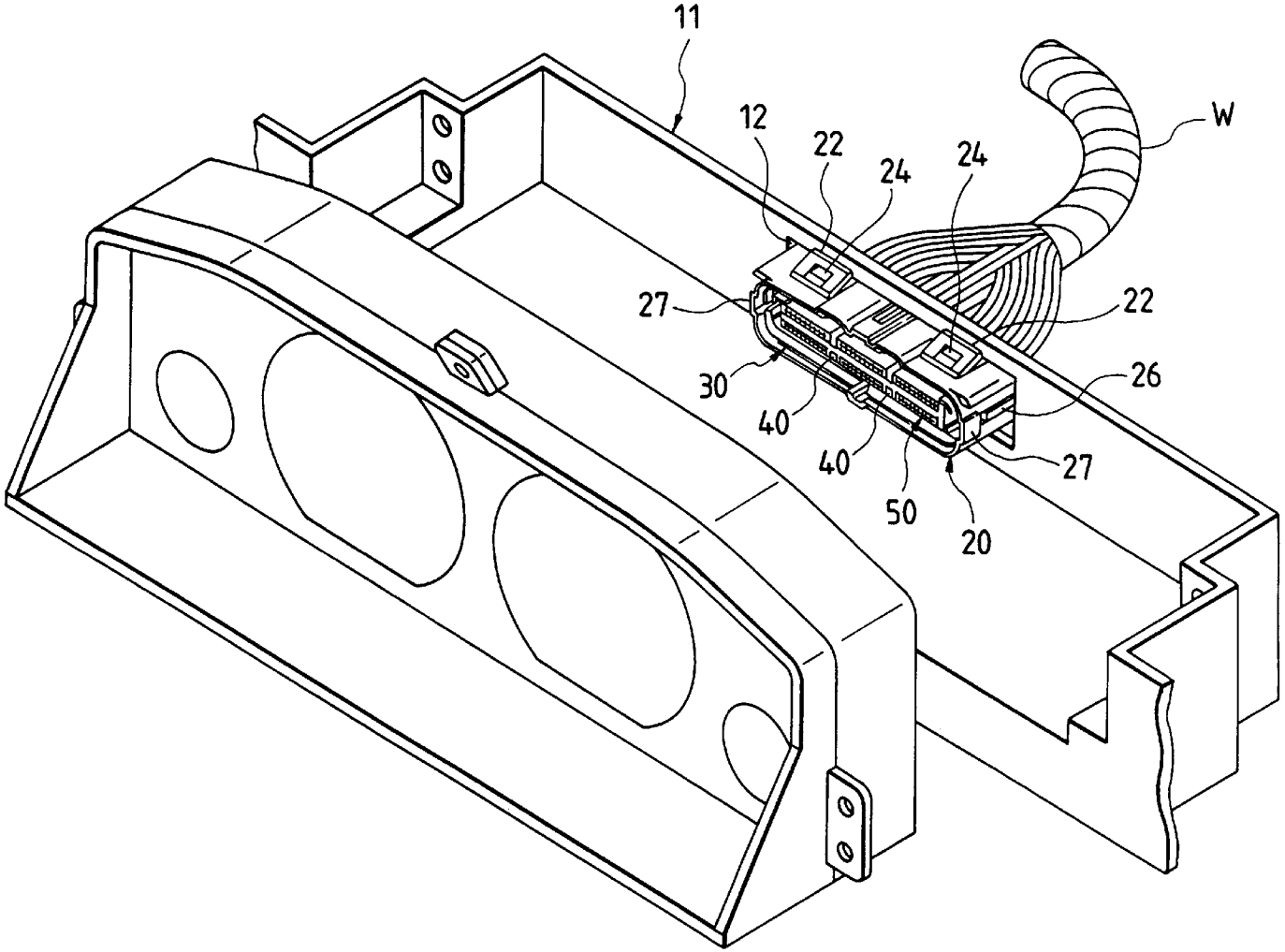
FIG. 11 is a perspective view showing a state in which the connector is attached to the inner panel.
Figure 12A:
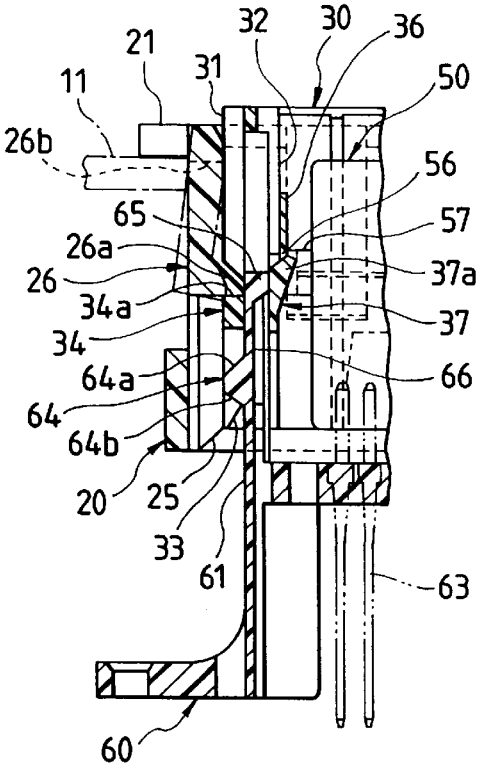
FIG. 12(*a*) is a schematic illustration showing a state at the initial stage of engagement of the connector, FIG. 12(*b*) is a schematic illustration showing a state at the middle stage of engagement of the connector, FIG. 12(*c*) is a schematic illustration showing a state at the completion of engagement of the connector, and FIG. 12(*d*) is a schematic illustration showing a state of alignment after the completion of engagement of the connector.
Figure 12B:
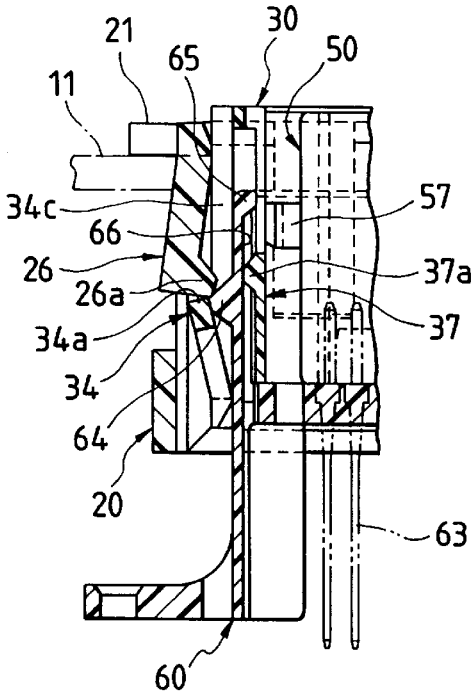
Figure 12C:
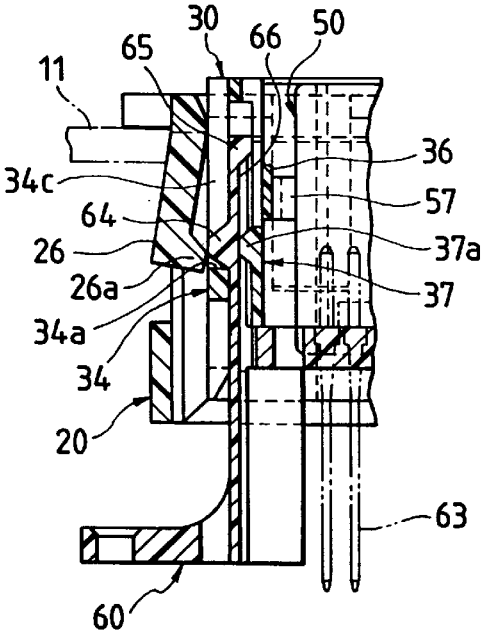
Figure 12D:
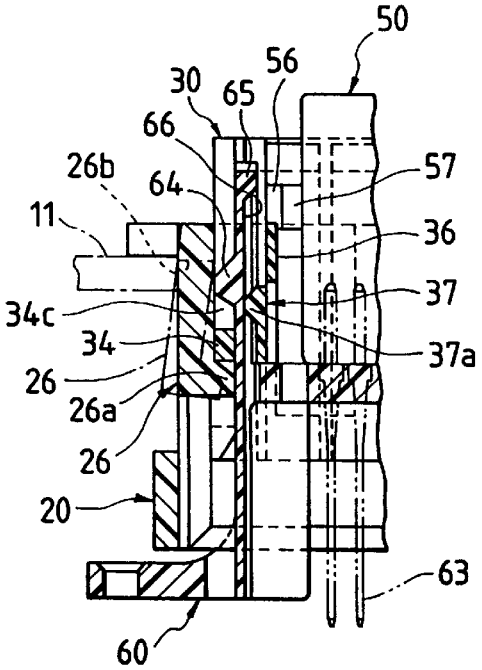
Figure 13:
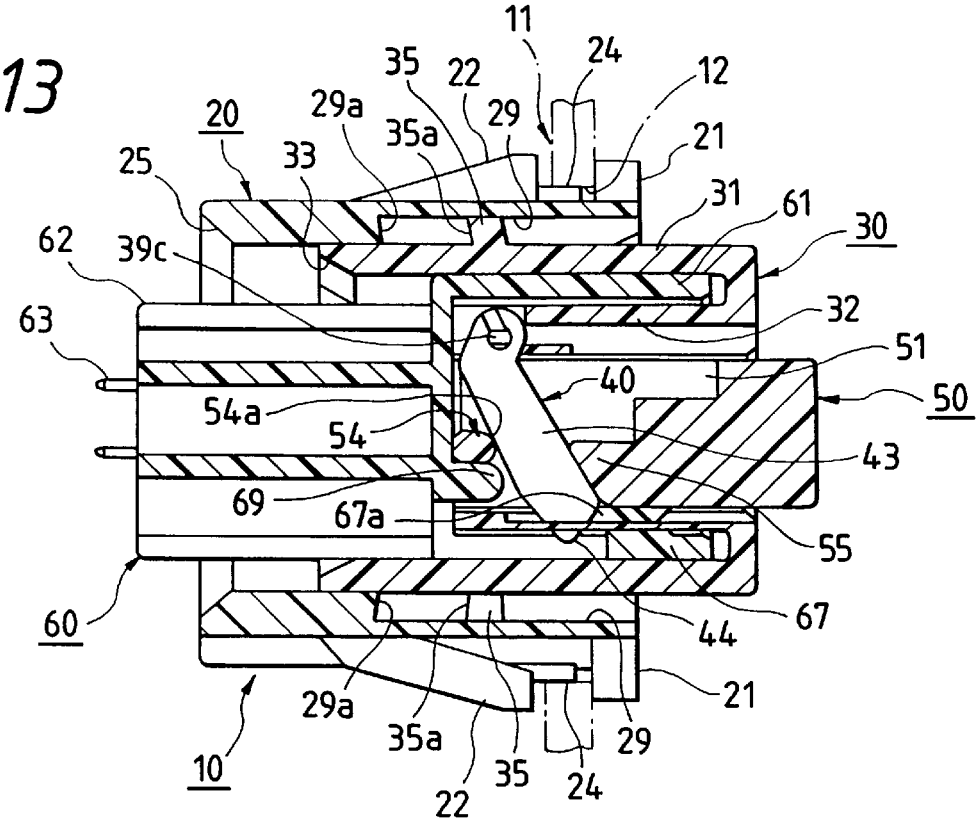
FIG. 13 is a cross-sectional side view showing a state of alignment after the complete engagement of the connector.

As shown in FIG. 2, the size between the alignment members 24 of the upper 20*a* and the lower wall 20*b* of the holder 20 is set to be the same as the size of the attaching hole 12 on the inner panel 11 in the direction of height. Under the condition shown in FIG. 1 that the male connector housing 50 is provisionally engaged in the cover 30 and also the cover 30 is provisionally engaged in the holder 20, as shown in FIGS. 10 and 11, when the holder 20 is inserted from the rear of the attaching hole 12 on the inner panel 11, each flexible engagement member 22 is bent inside, and such portions of the front 11*a* and the rear surface 11*b* of the inner panel 11 in the vicinity of the attaching hole 12 are interposed and engaged between each flexible engagement member 22 and each stopper 21. As shown in FIG. 2, at this time, the upper 24 and the lower alignment member 24 are elastically engaged in the attaching hole 12.

Figure 5:
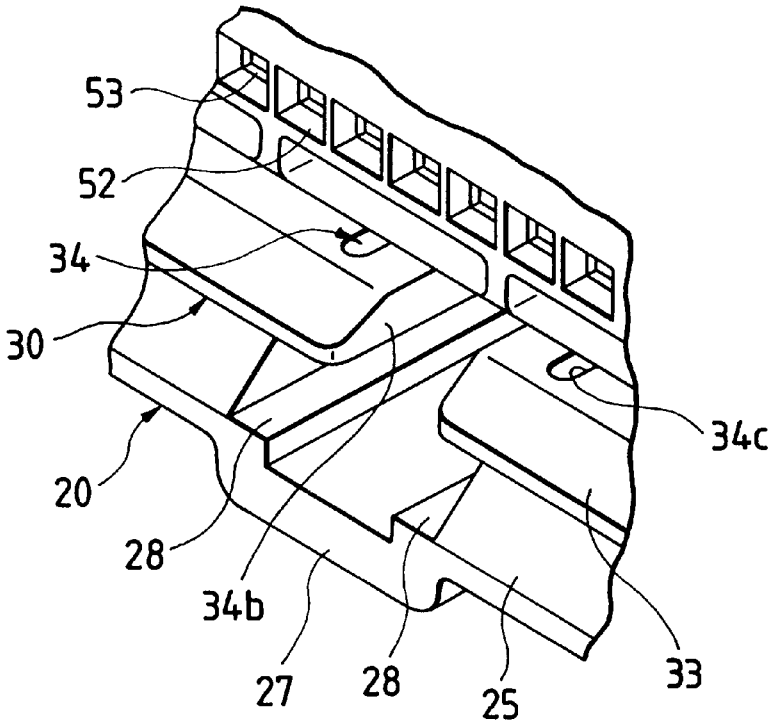
FIG. 5 is a perspective view of an essential portion of the male connector housing.
Figure 7A:
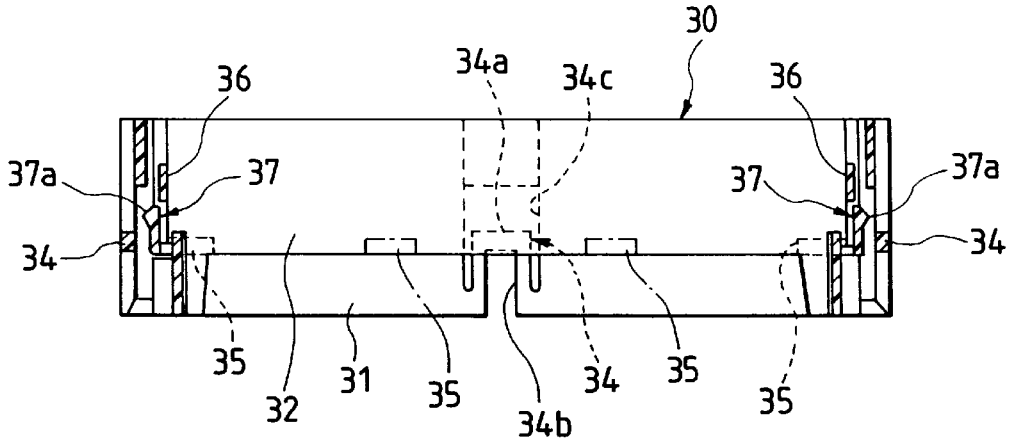
FIG. 7(*a*) is a cross-sectional view of a cover for holding the male connector, FIG. 7(*b*) is a side view of the cover, and FIG. 7(*c*) is a cross-sectional view of a holder for accommodating the cover.
Figure 7B:
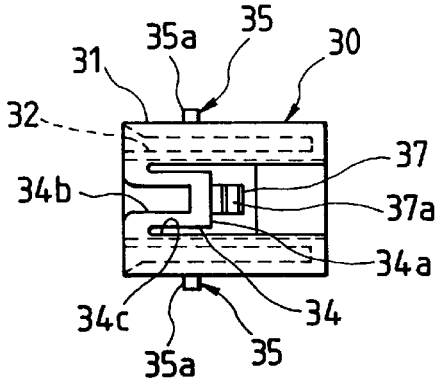
Figure 7C:
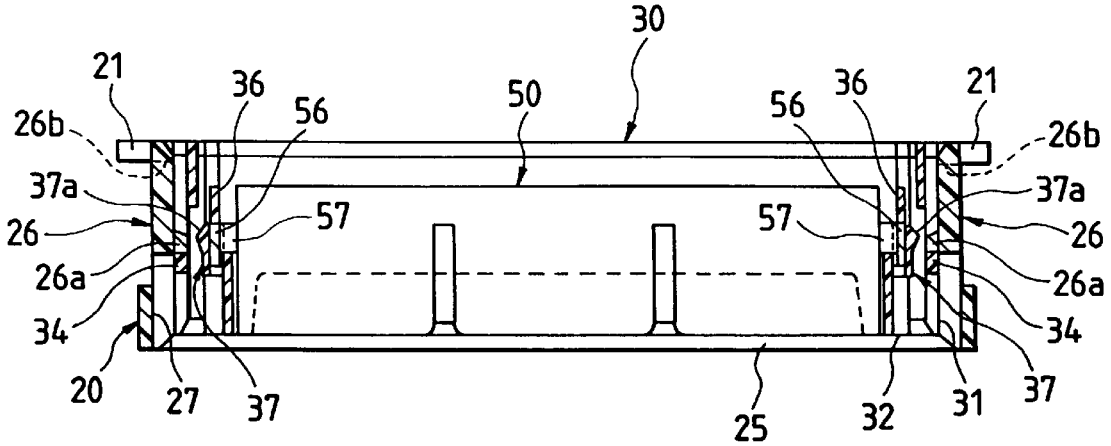

As shown in FIGS. 1 to 3, on the entire circumference of the front end section of the front opening of each wall 20*a*, 20*b* and 20*c* of the holder 20, there is formed a tapered face 25 for guiding the female connector housing 60 when it is engaged. In a portion from the center of the rear of each wall 20*a*, 20*b* and 20*c*, there is integrally formed an L-shaped flexible arm (provisional engagement means) 26 via a reverse C-shaped slit 26*b*. As shown in FIG. 7(*c*), inside of the forward end of each flexible arm 26, there is integrally formed a protrusion (engagement portion) 26*a*, the shape of which is trapezoidal. Further, at a position on the front side on each wall 20*a*, 20*b* and 20*c* of the holder 20 opposed to each flexible arm 26, there is formed a recess 27 for preventing the holder from opening, and the recess 27 is formed in such a manner that the recess 27 protrudes outside in a C-shape. As shown in FIGS. 1 and 5, in a portion from the front side to the center on the inner wall surface on both sides of each recess 27 of each wall 20*a*, 20*b* and 20*c* of the holder 20, there are formed a pair of clearances 28 used for accommodating the flexible engagement piece 34 of the cover 30, which will be described later, when it is deformed.

Figure 18:
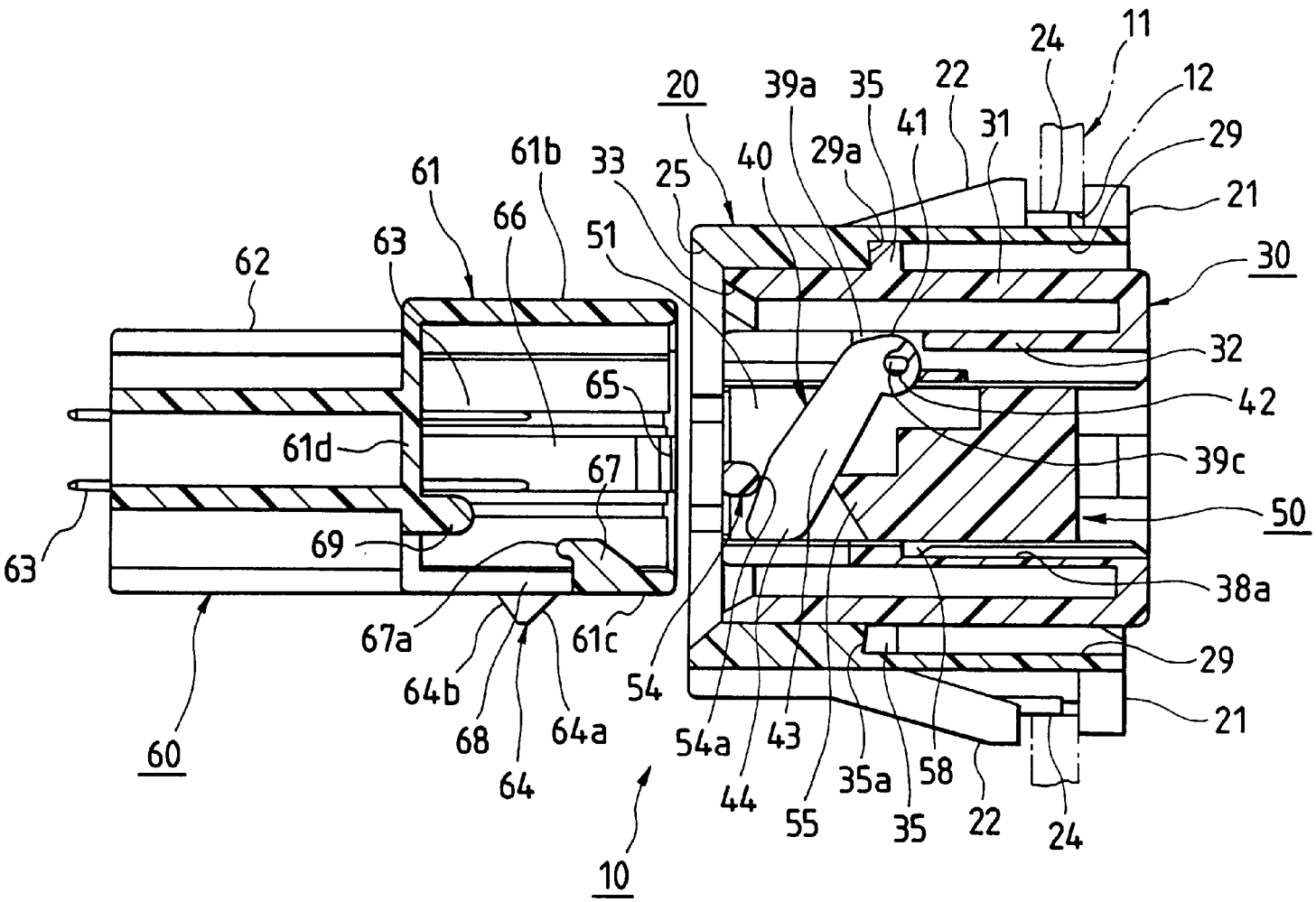
FIG. 18 is a cross-sectional side view showing a state after the disengagement of the connector.
Figure 19:
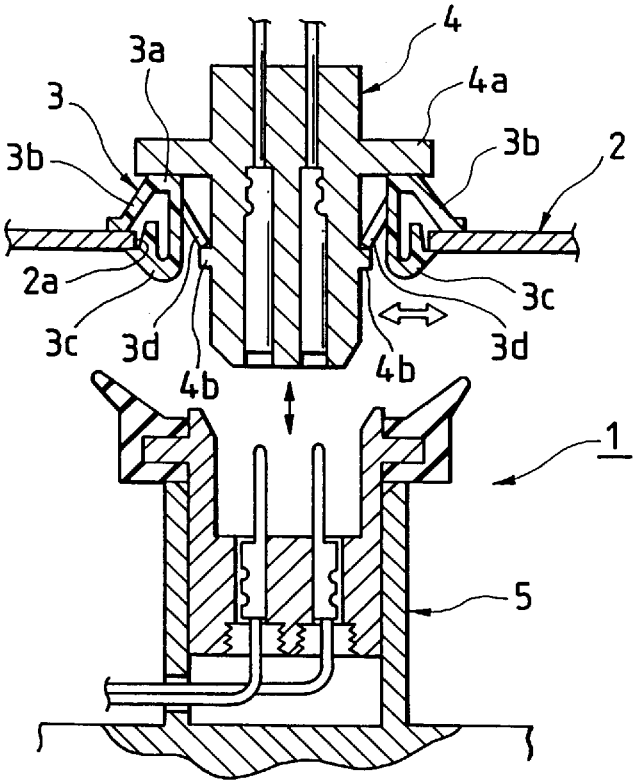
FIG. 19 PRIOR ART
FIG. 19 is a cross-sectional view showing a state before the engagement of a related connector.
Figure 20:
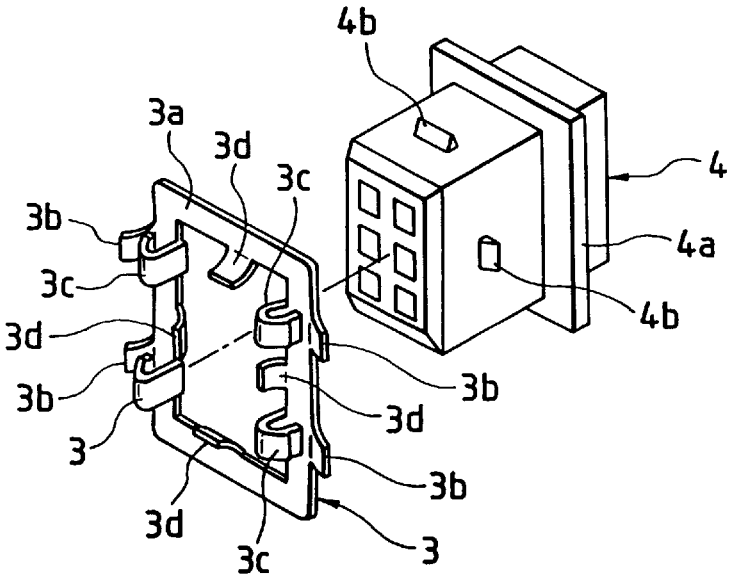
FIG. 20 PRIOR ART
FIG. 20 is an exploded perspective view of a male connector housing of the related connector.

Further, as shown in FIGS. 3 and 4, there are formed a pair of guide grooves 29 at such positions on the inner wall surface of the upper wall 20*a* of the holder 20 having high rigidity, that is, there are formed a pair of guide grooves 29 at a reinforced portion on both sides of the central recess 27 close to the lever 40, and also there are formed a pair of guide grooves 29 at such positions on the inner wall surface of the lower wall 20*b* of the holder 20 having high rigidity, that is, there are formed a pair of guide grooves 29 at a portion close to the reinforced portion of the stopper 21 on both sides. As shown in FIGS. 2 and 18, there is formed a reversely tapered face 29*a* at the front end of each guide groove 29.

As shown in FIGS. 3 and 7, the cover 30 is composed of a substantially flat square cylinder-shaped outer wall 31 and a substantially flat square cylinder-shaped inner wall 32 integrally formed in the outer wall 31, that is, the cover 30 is composed of a double structure of the substantially flat square cylinder-shaped outer wall 31 and the substantially flat square cylinder-shaped inner wall 32. A hood section 61 of the female connector housing 60, which will be described later, is accommodated from between the outer wall 31 and the inner wall 32, the front sides of which are open. In the inner wall 32, the male connector housing 50 is arranged in such a manner that it is provisionally engaged in an engagement waiting condition and it can be slidably moved.

Figure 6:
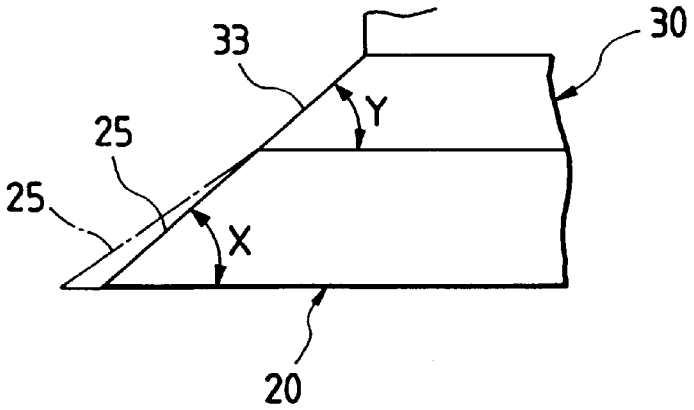
FIG. 6 is a schematic illustration of the essential portion of the male connector housing.

As shown in FIGS. 1 to 3 and FIGS. 5 and 6, on the entire circumference of the front end of the front side opening of the outer wall 31 of the cover 30, that is, at the end of the female connector housing 60 on the engagement side, there is formed a tapered face 33 used for guiding the female connector housing 60 when it is engaged. As shown in FIG. 6, the tapered face 33 of the cover 30 and the tapered face 25 of the holder 20 are formed so that they can form a substantially continuous slant face when the flexible arm 26 of the holder 20 and the provisional engagement member 34 of the cover 30 are provisionally engaged with each other. Namely, the tapered faces 25, 33 are formed so that the inequality of $Y \geqq X$ can be satisfied, wherein X is a taper angle of the tapered face 25 of the holder 20 and Y is a taper angle of the tapered face 33 of the cover 30.

As shown in FIG. 3 and FIGS. 7(*a*), 7(*b*) and 7(*c*), there are respectively provided provisional engagement member 34 for keeping the engagement waiting condition of the male connector housing 50 at the center on the front side of the upper and the lower wall of the outer wall 32 of the cover 30 and at the center on the front side of both side walls. Each provisional engagement member 34 is composed of a C-shaped flexible engagement piece engaged with and disengaged from the protrusion 26*a* of the flexible arm 26 of the holder 20. The each provisional engagement member 34 includes a recess 34*b* and slits 34*c* so that the provisional engagement member 34 can be elastically deformed outwards. The protrusion 26*a* of each flexible arm 26 of the holder 20 is to be abutted against a front end face 34*a*.

As shown in FIGS. 2, 3 and 4, there is respectively provided a stopper protrusion 35 at a position opposed to each guide groove 29 of the holder 20 on the outer surface side of the outer wall 31 of the cover 30. On the front side of each stopper protrusion 35, there is provided a reversely tapered face 35*a*, the slanted direction of which is the same as that of the tapered face 29*a* of the front end of each guide groove 29 of the holder 20. Therefore, in the engagement waiting condition of the male connector housing 50, the tapered face 29*a* of the front end of each guide groove 29 of the holder 20 securely comes into contact with the tapered face 35*a* of each stopper protrusion 35 of the cover 30.

Figure 8A:
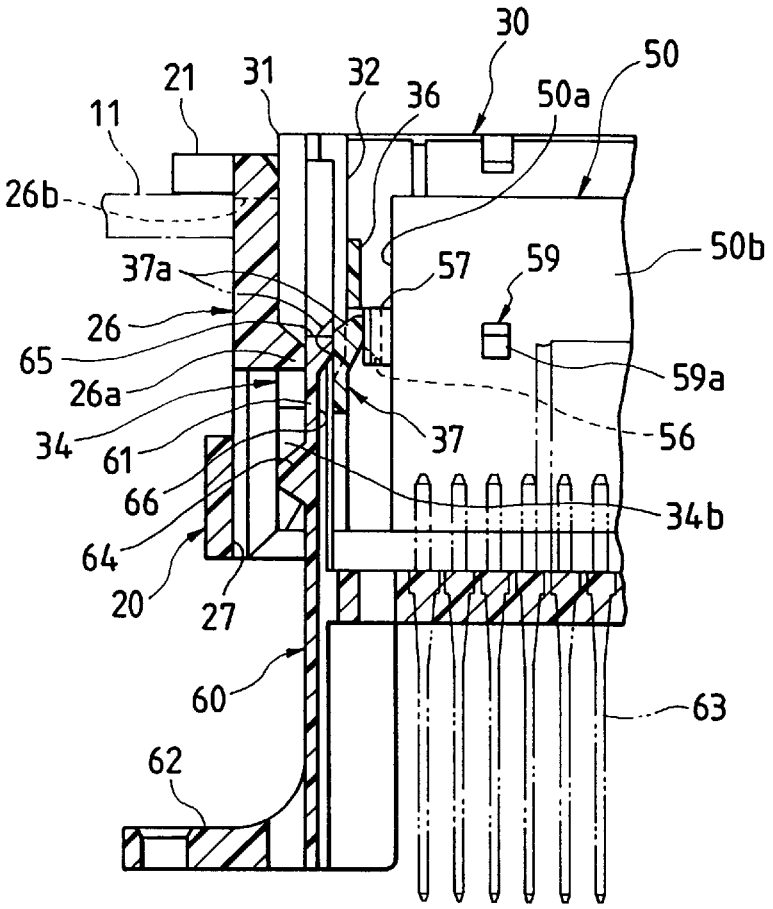
FIG. 8(*a*) is a cross-sectional view of essential portions of the male and the female connector housing at the initial stage of engagement, and FIG. 8(*b*) is a cross-sectional view of essential portions of the male and the female connector housing after the completion of engagement.
Figure 8B:
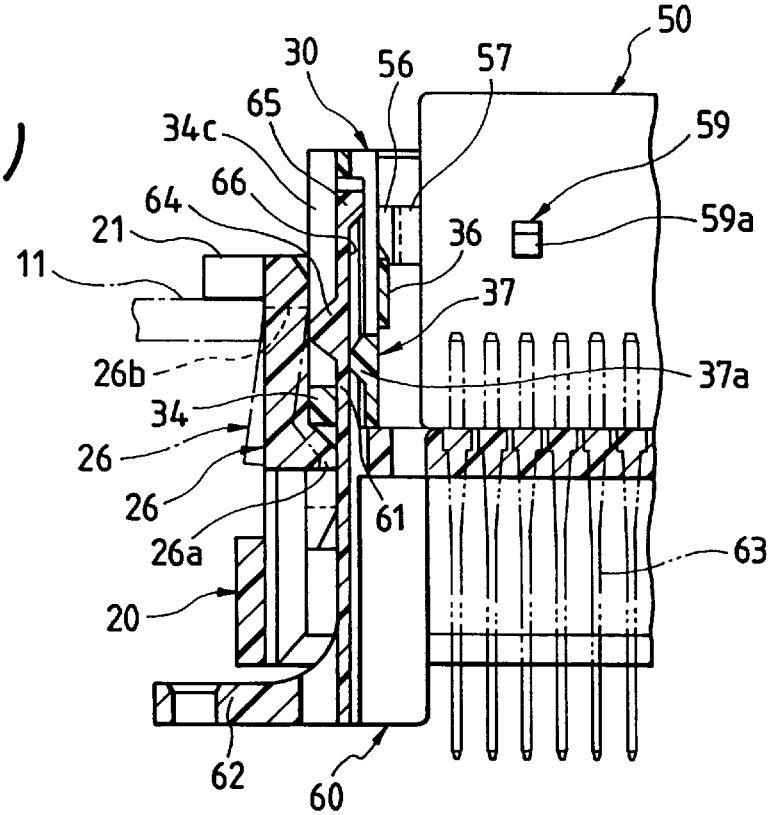

As shown in FIGS. 7(*a*), 7(*b*) and 7(*c*), at the centers of both side walls of the inner wall 32 of the cover 30, there are respectively provided provisional engagement stoppers 36. The provisional engagement lock member 56 of the male connector housing 50, which is in an engagement waiting condition, is provisionally engaged with each provisional engagement stopper 36. At the front position outside the provisional engagement stopper 36 at the center on the front side of both side walls of the inner wall 32 of the cover 30, there is respectively provided a flexible provisional engagement release arm 37 having the protrusion 37*a* outside at the forward end. As shown in FIG. 8(*a*), each flexible provisional engagement release arm 37 is bent and deformed inside by the provisional engagement release protrusion 65 of the female connector housing 60 described later. The provisional engagement lock member 56 of the male connector housing 50 is pushed inside by the deformation of each provisional engagement release arm 37. Therefore, the provisional engagement condition of each provisional engagement stopper 36 with the provisional engagement lock member 56 of the male connector housing 50 can be released.

As shown in FIG. 3 and FIGS. 7(*a*), 7(*b*) and 7(*c*), the center on the front side of the upper and the lower wall of the inner wall 32 of the cover 30 is cut out, and the size of the cutout is sufficient for substantially completely accommodating the male connector housing 50 in the engagement waiting condition. Further, in a portion of the cover 30, the shape of which is formed into a C-shape so that it is difficult to be deformed, and such portions on the inside of the upper and the lower wall of the inner wall 32 having high rigidity and close to the lever, there are respectively formed a pair of guide grooves 38*a* and 38*b*. As shown in FIG. 4, on both sides close to the center of the upper and the lower wall of the inner wall 32 of the cover 30, there are respectively provided a pair of lever relief grooves 39*a* and 39*b*. Between the pair of lever relief grooves 39*a* and 39*b*, there is respectively provided a lever 40.

As shown in FIGS. 3 and 4, each lever 40 is made of synthetic resin and formed into a substantially rectangular plate shape. At the center of the arcuate base end 41, there is formed a shaft hole 42. When the support shaft 39*c* protruding into the lever relief groove 39*a* on the upper wall side of the inner wall 32 of the cover 30 is inserted into this shaft hole 42 as shown in FIG. 18, the base end 41 of the lever 40 is pivotally supported.

As shown in FIG. 3, the male connector housing 50 is formed into a substantial rectangular parallelepiped made of synthetic resin having a pair of lever relief grooves 51 arranged from the front to the rear side. Between the front and the rear surface, there are provided a plurality of terminal accommodation chambers 52. In each terminal accommodation chamber 52, the female terminal (terminal) 53 is accommodated shown in FIG. 5, by which both connector housings 50 and 60 are conducted to each other when the female terminal 53 is electrically connected to each male terminal 63 of the female connector housing 60 described later. Each female terminal 53 is connected to wire harness W shown in FIGS. 10 and 11.

On the front side of each lever relief groove 51 of the male connector housing 50, there is provided a rod-shaped guide (point of application) 54 which is used as a portion at which the lever is hooked. As shown in FIG. 18, this guide 54 is provided with an arcuate surface 54*a* on which the middle section 43 of the lever 40 slides so that the point of application of the lever 40 can be formed. Further, at the rear of one side of each lever relief groove 51 of the male connector housing 50, there is provided a substantially trapezoidal lever pushing section 55 on which the middle section 43 of the lever 40 comes into contact and slides when the male connector housing 50 is in the engagement waiting condition. An interval between the guide 54 and the lever pushing section 55 is set to be small as shown in FIG. 18.

On the rear side of both sides 50*a* of the male connector housing 50, there is respectively provided a provisional engagement lock member 56, the cross section of which is trapezoidal, which is provisionally engaged with the provisional engagement stopper 36 of the cover 30 when the male connector housing 50 is in the engagement waiting condition. On both sides 50*a* of this provisional engagement lock member 56, there is provided a C-shaped flexible arm 57 which protrudes integrally. On the front side, there is formed a tapered face 56*a*. At positions opposing to the guide grooves 38*a* and 38*b* of the inner wall 32 of the cover 30 of the upper 50*b* and the lower face 50*c* of the male connector housing 50, there are provided stopper protrusions 58 and 59 which slide in the guide grooves 38*a* and 38*b*. One 58 of the stopper protrusions restricts a forward sliding motion of the connector housing 50, and the other stopper protrusion 59 restricts a backward sliding motion of the connector housing 50. There are formed two tapered faces 58*a* and 59*a* at positions opposed to each other.

Figure 9:
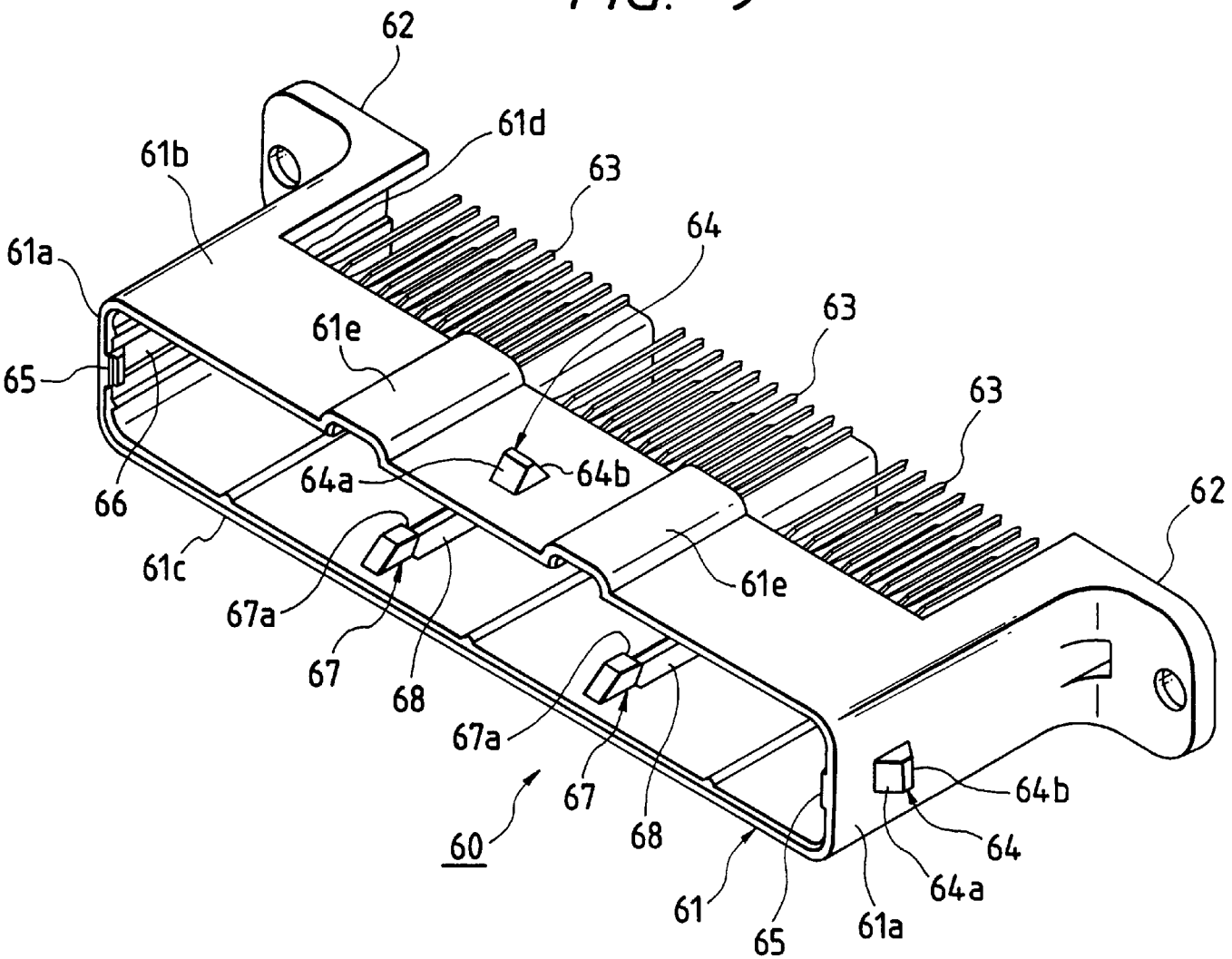
FIG. 9 is a perspective view of the female connector housing, wherein the view is taken from the front side.

As shown in FIGS. 1 and 9, in the female connector housing 60, a plurality of male terminals (terminals) 63 are exposed in the square cylinder-shaped hood 61 and between the L-shaped leg sections 62. When both connector housings 50 and 60 are engaged with each other, the hood 61 is inserted between the outer wall 31 and the inner wall 32 of the cover 30, so that the terminals 53 and 63 of both connector housings 50 and 60 can be electrically connected to each other.

As shown in FIG. 1 and 9, at the centers on the front side of the outer surfaces of both side walls 61*a* of the hood 61 of the female connector housing 60, and at the centers on the front side of the outer faces of the upper 61*b* and the lower wall 61*c*, protrusions 64 are respectively formed. These protrusions 64 function as a retaining member for keeping a provisional engagement condition between the protrusion 26*a* of the flexible arm 26 of the holder 20 and the flexible engagement piece 34 of the cover 30, and also these protrusions 64 function as a release member for releasing the provisional engagement condition between the protrusion 26*a* of the flexible arm 26 of the holder 20 and the flexible engagement piece 34 of the cover 30 when both connector housings 50 and 60 are engaged with and disengaged from each other. Each protrusion 64 is formed into a substantial triangle pole. The front side is formed into a tapered face (engagement face) 64*a*, and also the rear side is formed into a tapered face (disengagement face) 64*b*.

As shown in FIGS. 8(*a*), 8(*b*) and 9, at the front ends of the inner surfaces of both side walls 61*a* of the hood 61 of the female connector housing 60, there are provided provisional engagement release protrusions 65, the cross sections of which are trapezoidal, which are contacted with and separated from the protrusions 37*a* of the provisional engagement release arm 37 of the cover 30. At the centers of the inner surfaces of both side walls 61*a* of the hood 61, there are provided relief grooves 66 in which protrusions 37*a* of the provisional engagement release arms 37 of the cover 30 are accommodated and guided.

As shown in FIGS. 9 and 18, on both sides on the front side of the inner surface of the lower wall 61*c* of the hood 61 of the female connector housing 60, there are provided ribs (engaging section) 67 which integrally protrude from the inner surface of the lower wall 61*c*. At the upper end on the rear side of this rib 67, there is integrally provided a protrusion 67*a* on which the forward end 44 of the lever 40 slides. The forward end 44 of the lever 40 slidably comes into contact with this protrusion 67*a* so that this protrusion 67*a* functions as a fulcrum of the lever 40 when the hood 61 of the female connector housing 60 is inserted between the outer wall 31 of the cover 30 and the inner wall 32 so as to draw the female connector housing 60 into the male connector housing 50 so that both connector housings 50 and 60 can be engaged with and disengaged from each other. Further, there is formed a lever relief groove 68 from the rear of the rib 67 of the lower wall 61*c* of the hood 61 to the vertical partition wall 61*d*. Further, on the lower side of the partition wall 61*d*, there is integrally provided a lever pushing member 69 with which the middle portion 43 of the lever 40 comes into contact.

In this connection, as shown in FIGS. 1 and 4, the guide grooves 29 on both sides of the upper wall 20*a* of the holder 20 are formed in such a manner that they are protruded upward. There are provided protruding sections 31*e*, 32*e* and 61*e*, which protrude upward, on the upper wall side of the outer wall 31 and the inner wall 32 of the cover 30 opposing to the protruding section 20*e*, and also on the upper wall 61*b* side of the hood 61 of the female connector housing 60 opposing to the protruding section 20*e*.

According to the connector 10 of the above embodiment, as shown in FIGS. 10 and 11, when the male connector housing 50 on the side of wire harness W is attached to the attaching hole 12 on the inner panel 11 through the holder 20, the holder 20 is inserted into and pressed against the attaching hole 12 on the inner panel 11 from the rear side. In this way, the connector housing 50 can be secured in such a manner that the front surface 11*a* and the rear surface 11*b* of the inner panel 11 are interposed and secured between the upper and the lower flexible engaging member 22 of the holder 20 and the upper, the lower, the right and the left stopper 21. In this engagement, as shown in FIG. 2, when the upper and the lower alignment member 24 of the holder 20 are brought into contact with the end faces of the attaching hole 12 of the inner panel 11, even if the holder 20 moves in the attaching hole 12 in the vertical and the horizontal direction, alignment can be conducted when each alignment member 24 is bent, that is, the holder 20 can be adjusted at the center of the attaching hole 12. In this way, the holder 20 can be positively engaged and secured onto the inner panel 11. Even after the completion of engagement, the holder 20 tends to be positioned at the center of the attaching hole 12 by the effect of elasticity of each alignment member 24. Accordingly, while the flexible engagement member 22 is engaged with the inner panel 11 by a predetermined margin, the entire connector 10 can be held on the inner panel by a stronger holding force. Further, a space in which the connector is attached onto the inner panel can be reduced.

After the male connector housing 50 has been attached to the attaching hole 12 on the inner panel 11 thorough the holder 20, the female connector housing 60 is engaged with the male connector housing 50 which is in the engagement waiting condition. Referring to FIGS. 12(*a*) to 12(*d*), the engagement of the male connector housing 50 with the female connector housing 60 will be explained below. As shown in FIG. 12(*a*), the hood 61 of the female connector housing 60 is inserted between the outer wall 31 and the inner wall 32 of the cover 30. In the above initial engagement condition of the connector housing 50 with the connector housing 60, the engagement waiting condition of the male connector housing 50 can be kept by the provisional engagement condition of the protrusion 26*a* of each flexible arm 26 of the holder 20 with the forward end face 34*a* of each flexible engagement piece 34 of the cover 30. When the hood 61 of the female connector housing 60 is inserted between the outer wall 31 and the inner wall 32 of the cover 30, the hood 61 of the female connector housing 60 can be smoothly guided onto the male connector housing side 50 by the tapered face 25 of the holder 20 and the tapered face 33 of the cover 30 arranged so as to form a substantially continuous slant face. Due to the foregoing, there is no possibility that the end on the engagement side of the hood 61 of the female connector housing 60 collides with the holder 20 and the front end of the cover 30 and that the provisional engagement condition of the protrusion 26*a* of each flexible arm 26 of the holder 20 with the forward end surface 34*a* of each flexible engagement piece 34 of the cover 30 is released.

As shown in FIG. 12(*a*), when both connector housings 50 and 60 start engaging with each other, the provisional engagement release protrusion 65 of the hood 61 of the female connector housing 60 collides with the protrusion 37*a* of the flexible provisional engagement release arm 37 of the cover 30, and the provisional engagement release arm 37 is bent inwards. In this way, the provisional engagement lock member 56 of the male connector housing 50 is pushed inwards. Due to the foregoing, the flexible arm 57 of the male connector housing 50 is bent inwards, and the provisional lock of the provisional lock member 56 and the provisional engagement stopper 36 of the cover 30 can be released. Therefore, the male connector housing 50 is slid to rearwards inside the inner wall 32 of the cover 30. In this connection, after the completion of engagement, the protrusion 37*a* of the flexible provisional engagement release arm 37 of the cover 30 enters the relief groove 66 of the hood 61 of the female connector housing 60 as shown in FIG. 12(*b*). Accordingly, the provisional engagement release arm 37 returns to the initial condition.

Next, as shown in FIG. 12(*b*), in the middle of engagement of the connector housing 50 with the connector housing 60, each flexible engagement piece 34 of the cover 30 is elastically deformed outwards by a pushing force of each protrusion 64 of the female connector housing 60. Therefore, the forward end face 34*a* of each flexible engagement piece 34 of the cover 30 comes into contact with an upper end face of each flexible arm 26 of the holder 20. In this way, the provisional engagement condition of the protrusion 26*a* of each flexible arm 26 of the holder 20 with the forward end face 34*a* of each flexible engagement piece 34 of the cover 30 can be more positively kept.

After the engagement of both connector housings 50 and 60 has been completed as shown in FIG. 12(*c*), each protrusion 64 of the female connector housing 60 enters the slit 34*c* at the rear of each flexible engagement piece 34 of the cover 30. At this time, the tapered face 64*a* of each protrusion 64 of the female connector housing 60 pushes only the protrusion 26*a* of each flexible arm 26 of the holder 20 outwards. Therefore, each flexible arm 26 is elastically deformed outwards. Due to the foregoing, as shown in FIGS. 12(*c*) and 12(*d*), the provisional engagement condition of the protrusion 26*a* of each flexible arm 26 of the holder 20 with the forward end face 34*a* of each flexible engagement piece 34 of the cover 30 can be released, and both connector housings 50 and 60, the engagement of which has been completed, slide backward in the cover 30. After this sliding motion has been completed, the connector 10 is kept in the alignment condition as shown in FIGS. 12(*d*) and 13.

Figure 15:
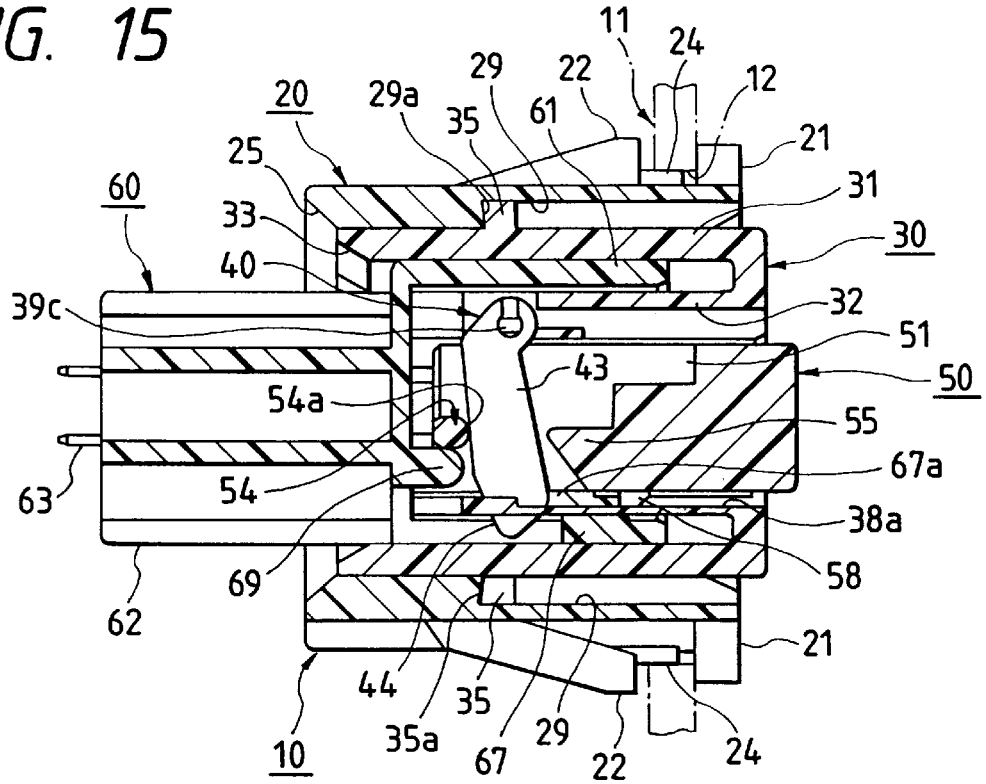
FIG. 15 is a cross-sectional side view showing a state in the middle of disengagement of the connector.
Figure 16:
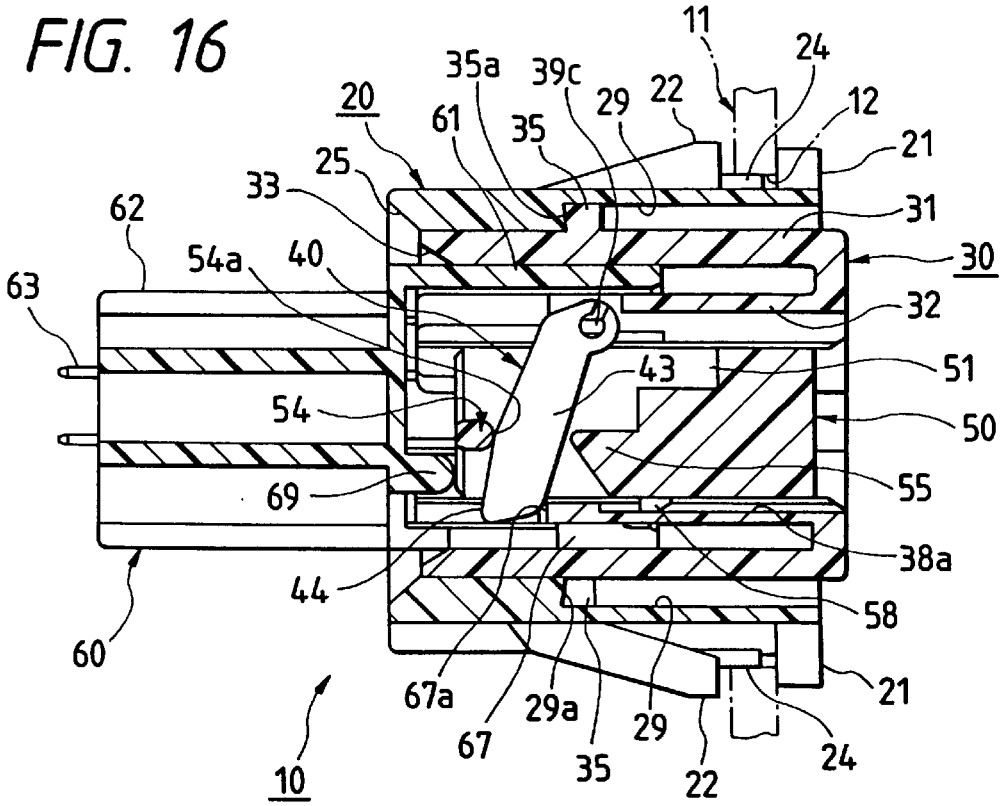
FIG. 16 ia cross-sectional side view showing a state in the middle of disengagement of the connector.
Figure 17:
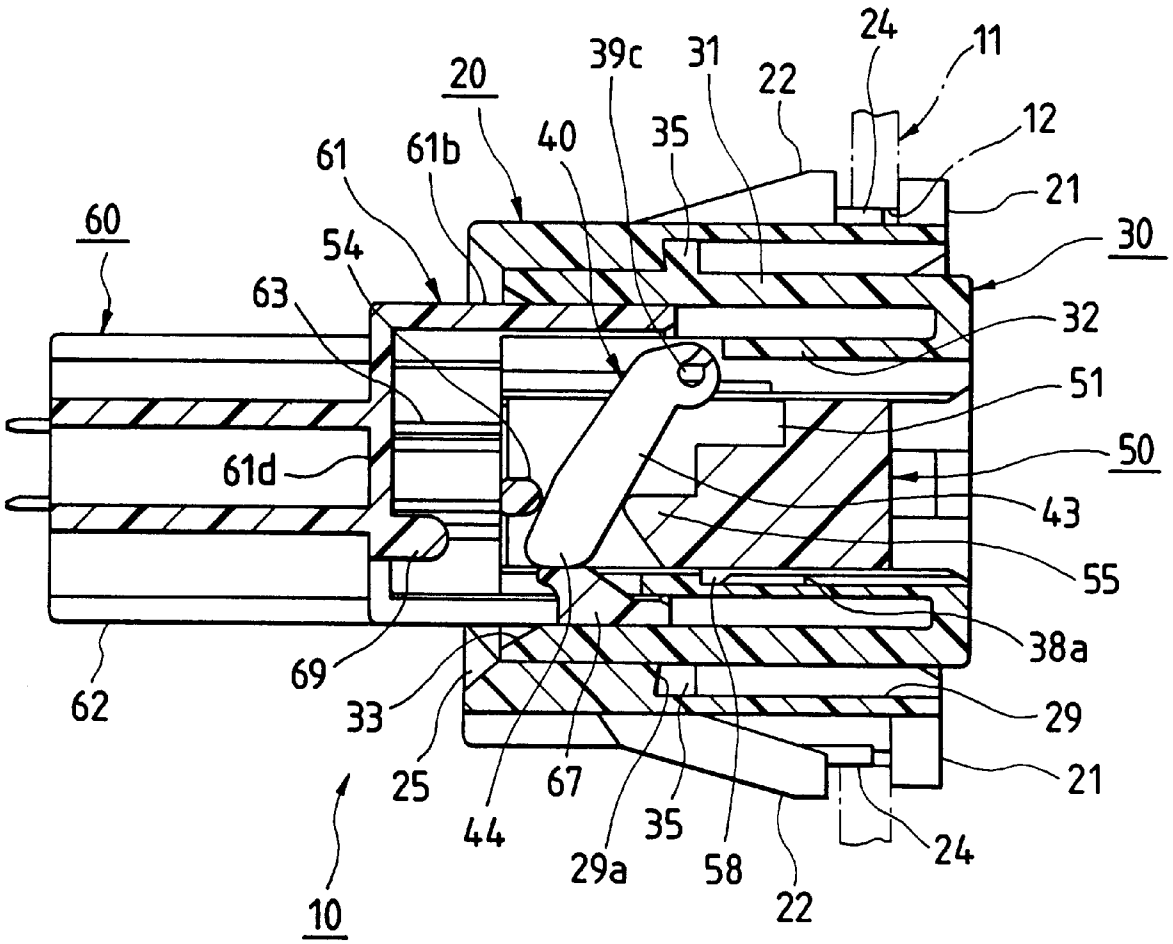
FIG. 17 is a cross-sectional side view showing a state in which the terminals are disengaged in the middle of disengagement of the connector.

The process of engagement from the initial condition to the final condition of engagement of the connector housing 50 with the connector housing 60 will be explained below while the explanation is made in relation to the lever 40. As shown in FIG. 17, the hood 61 of the female connector housing 60 is inserted between the outer wall 31 and the inner wall 32 of the cover 30, and the female connector housing 60 is pushed in the direction of engagement of both connector housings 50 and 60. Then, as shown in FIG. 16, the forward end 44 of the lever 40 comes into contact with the protrusion 67*a*, which is used as a fulcrum of the lever, of the rib 67 in the hood 61 of the female connector housing 60. Therefore, the lever 40 starts rotating. When the female connector housing 60 is further pushed in the direction of engagement as shown in FIG. 15, the hood 61 of the female connector housing 60 is drawn between the outer wall 31 and the inner wall 32 of the cover 30 by the action of the lever 40, so that both connector housings 50 and 60 can be engaged with each other. In this action of lever, the shaft 39*c* for pivotally supporting the base end 41 of the lever 40 is a point of force, the arc surface 54*a* of the guide 54 of the male connector housing 50 is a point of application, and the protrusion 67*a* of the rib 67 of the female connector housing 60 is a fulcrum. As a result of the action of the lever 40, even when the female connector housing 60 is slid in the direction of engagement by a low operation force, both connector housings 50 and 60 can be easily engaged with each other.

Figure 14:
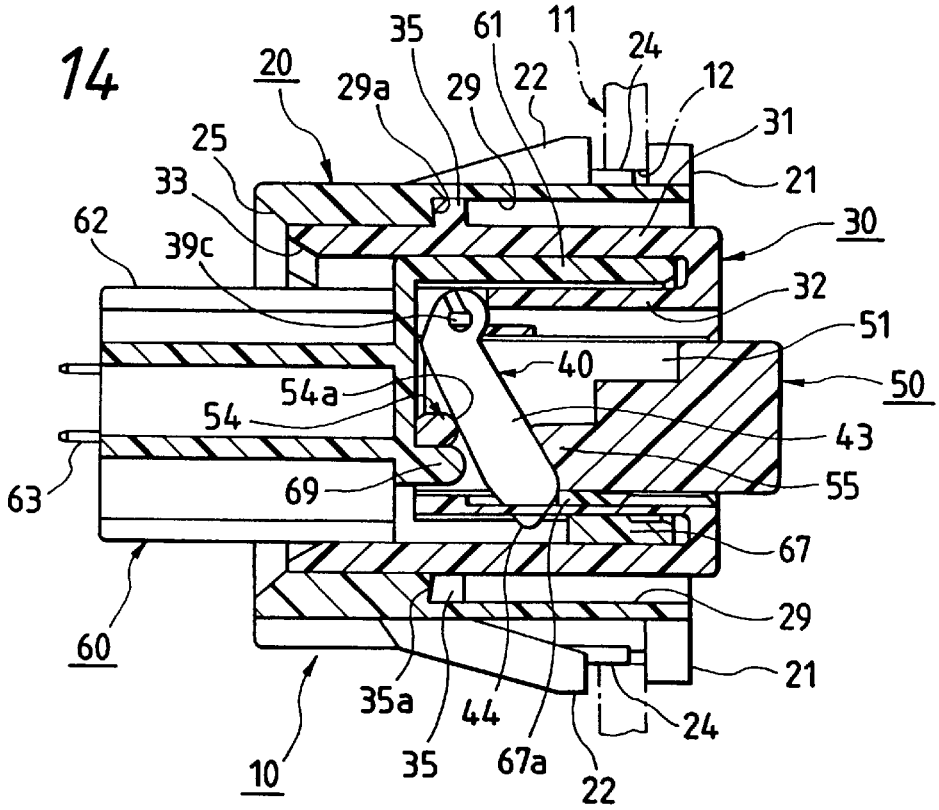
FIG. 14 is a cross-sectional side view showing a state of the complete engagement of the connector.

When both connector housings 50 and 60, which are set in the complete engagement condition, are disengaged from each other for the purpose of maintenance or inspection, they are operated as follows. Operation is conducted as follows from the start of disengagement of both connector housings 50 and 60 shown in FIG. 14 to the completion of disengagement of the female terminal 53 from the male terminal 63 shown in FIG. 17. The forward end 44 of the lever 40 comes into contact with the protrusion 67*a*, which is used as a fulcrum of the lever, of the rib 67 in the hood 61 of the female connector housing 60, and the lever 40 is rotated in the reverse direction to that of engagement, so that disengagement is conducted while the guide 54 of the male connector housing 50 is being drawn. Simultaneously when the rib 67 in the hood 61 of the female connector housing 60 passes under the forward end 44 of the lever 40 in the condition shown in FIG. 17, disengagement of the female terminal 53 from the male terminal 63 is completed. As a result of the action of the lever 40, even when the female connector housing 60 is slid and drawn in the direction of disengagement by a low operation force, both connector housings 50 and 60 can be easily disengaged from each other.

As has been described heretofore, according to the present invention, the holding force of the connector with respect to the panel body can be increased, and it is possible to reduce a required space in which the connector is attached to the panel body.

In addition, since the alignment members is formed by erecting an inner portion of a substantially C-shaped slit provided on the each flexible engagement member formed into a shape of a plate, and abutting against an inner edge of the attaching hole, the alignment member can be easily moved within the slit. Therefore, the connector can be smoothly aligned, that is, the connector can be smoothly positioned at the center of the attaching hole of the panel body.

Further, according to the present invention, when the hood portion is inserted between the outer peripheral face of the cover and the inner peripheral face of the holder, the hood portion can be smoothly guided onto the male connector housing side by the tapered face of the holder and the tapered face of the cover member arranged so as to form a substantially continuous slant face. Therefore, there is no possibility that the front end portion of the hood portion collides with the holder and the front end of the cover and that the provisional engagement of the protrusion of the cover and the holder is released.

Still further, according to the present invention, since the connector further comprises levers, the first and second connector housings are engaged or disengaged even by a low operation force according to the leverage thereof.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector, which is attached into an attaching hole formed on a panel body and has an engagement waiting state and a complete engagement state, comprising:

a first connector housing;

a cover member for accommodating the first connector housing therein so as to be slidable relative thereto in an engagement direction;

a holder for accommodating the cover so as to be engaged therewith provisionally under the engagement waiting state and so as to be slidable relative thereto in the engagement direction under the complete engagement state, the holder includes at least one pair of stoppers on the rear face of the panel body in a peripheral portion of the attaching hole, at least one pair of flexible engagement members elastically abutting against a front face of the panel body in the peripheral portion of the attaching hole and at least one pair of alignment members elastically fitted into the attaching hole; and a second connector housing to be engaged with the first connector housing.

2. The connector as set forth in claim 1, wherein each of the alignment members is formed by an inner portion of a substantially C-shaped slit provided on the each flexible engagement member formed into a shape of a plate, and wherein the alignment members abut against an inner edge of the attaching hole.

3. The connector as set forth in claim 1, wherein the engagement waiting state includes a first engagement waiting state and a second engagement waiting state, a first engaging arm provided on the cover member is provisionally engaged with a protrusion provided on the first connector housing under the first engagement waiting state and the complete engagement state, and a second engaging arm provided on the cover member is provisionally engaged with a third engaging arm provided on the holder under the first and second engagement waiting states.

4. The connector as set forth in claim 3, wherein the second connector housing includes a hood portion provided in a front portion thereof which is to be inserted into a gap between an outer peripheral face of the cover member and an inner peripheral face of the holder, a first protrusion formed on a front end portion of an inner face of the hood portion, and a trapezoidal second protrusion having a front slant face and a rear slant face, the second protrusion formed on an outer face of the hood portion and located rearwardly of the first protrusion, the first protrusion flexes the first engagement arm inwards to release the provisional engagement of the first connector housing and the cover member, and the front slant face of the second protrusion flexes both of the second engaging arm and the third engaging arm outwards such that end portions thereof keep the provisional engagement of the cover member and the holder under the second engagement waiting state, and the rear slant face of the second protrusion flexes only the third engaging arm outwards to release the provisional engagement of the cover member and the holder under the complete engagement state.

5. The connector as set forth in claim 1, wherein front end portions of the cover member and the holder are tapered.

6. The connector as set forth in claim 5, wherein the cover member and the holder are arranged such that the tapered faces thereof form one substantially continuous slant face under the engagement waiting state.

7. The connector as set forth in claim 6, wherein a slant angle X of the tapered face of the holder and a slant angle Y of the tapered face of the cover member satisfy an inequality: $X \geqq Y$ (here, $X=Y$).

8. The connector as set forth in claim 1, further comprising:

a lever member disposed in a groove formed on a front end portion of the first connector housing extending in a vertical direction and supported by a pivot formed on the cover member so as to be rotatable in the engaging direction within the groove, and wherein the lever member allows the engagement and disengagement operation of the first connector housing and the second connector housing, a contact point of a front end portion of the second connector housing and the lever member is a fulcrum and a contact point of the front end portion of the first connector housing and the lever member is a point of application of force.

* * * * *